United States Patent [19]

Hart et al.

[11] Patent Number: 4,579,441

[45] Date of Patent: Apr. 1, 1986

[54] DETACKING APPARATUS

[75] Inventors: Lawrence M. Hart, Ontario; Oscar G. Hauser, Rochester, both of N.Y.

[73] Assignee: Xerox Corporation, Stamford, Conn.

[21] Appl. No.: 625,569

[22] Filed: Jul. 2, 1984

Related U.S. Application Data

[63] Continuation of Ser. No. 446,745, Dec. 3, 1962, abandoned.

[51] Int. Cl.[4] ..... G03G 21/00

[52] U.S. Cl. ..... 355/3 CH; 355/3 TR; 361/214; 361/221; 271/307; 271/900

[58] Field of Search ..... 355/3 R, 3 CH, 14 CH, 355/3 TR; 361/214, 212, 220, 221, 230; 271/307, 308, 311, 312, 313

[56] References Cited

U.S. PATENT DOCUMENTS

| | | | |
|---|---|---|---|
| 2,483,542 | 10/1949 | Hooper | 175/264 |
| 3,575,502 | 4/1971 | Eppe | 355/3 |
| 3,716,755 | 2/1973 | Marx | 317/2 |
| 3,757,164 | 9/1973 | Binkowski | 361/212 |
| 3,912,257 | 10/1975 | Gibbons | 271/174 |
| 4,068,284 | 1/1978 | Wheeler et al. | 361/230 |
| 4,190,348 | 2/1980 | Friday | 355/3 TR |
| 4,341,456 | 7/1982 | Iyer et al. | 355/3 TR |
| 4,352,143 | 9/1982 | Uno | 361/221 |
| 4,363,070 | 12/1982 | Kisler | 361/212 |
| 4,417,800 | 11/1983 | Hirose et al. | 355/3 TR |

FOREIGN PATENT DOCUMENTS

| | | |
|---|---|---|
| 2408728 | 8/1974 | Fed. Rep. of Germany . |
| 2536091 | 2/1977 | Fed. Rep. of Germany . |

*Primary Examiner*—R. L. Moses

*Attorney, Agent, or Firm*—Samuel E. Mott, III

[57] ABSTRACT

Electrostatographic apparatus comprising an imaging surface with an electrostatic transfer evice to transfer toner particles to a receiving sheet and an apparatus to detack the sheet from the drum comprising a plurality of conductive fibers extending cross the rear side of the receiving sheet which are spaced from the sheet and have applied thereto a low voltage direct current potential of a polarity opposite the polarity on the receiving sheet and sufficient to cause air breakdown between the receiving sheet and the end of the fibers to provie a controlled neutralization of charge on the receiving sheet to a potential level above zero and thereby separate the receiving sheet from the drum by virtue of its own weight and beam strength.

15 Claims, 7 Drawing Figures

PAPER CHARGE NEUTRALIZATION

DETACKING APPARATUS

This is a continuation of application Ser. No. 446,745, filed Dec. 3, 1982, now abandoned.

BACKGROUND OF THE INVENTION

This invention relates to electrostatographic reproducing apparatus and more particularly to a method and apparatus for detacking electrostatically a toner receiving substrate tacked to an imaging surface.

In the electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder, referred to in the art as toner. Most development systems employ a developer material which comprises both charged carrier particles and charged toner particles which triboelectrically adhere to the carrier particles. During development, the toner particles are attracted from the carrier particles by the charge pattern of the image areas on the photoconductive insulating area to form a powder image on the photoconductive area. This image may subsequently be transferred to a support surface such as a copy paper to which it may be permanently affixed by heating or by the application of pressure. Following transfer of the toner image to the support surface, the photoconductive insulating surface is cleaned of residual toner to prepare it for the next imaging cycle.

In such apparatus' it is common to electrostatically transfer the toner image from the imaging surface to the support surface, such as paper. This is typically done by charging the copy sheet from its rear face to the same polarity and substantially the same potential as the potential in the electrostatic latent image. In this process, electrostatic forces are created which cause attraction between the photoconductive layer and the copy sheet so that the copy sheet tends to adhere to the photoconductive layer. Previously, several mechanical means have been proposed for stripping or separating the copy sheet from the photoconductive layer. Typical of these devices are the mechanical fingers, gripper bars, and other devices which physically grab at least the lead edge of the copy sheet. The difficulty associated with these is that in the process of gripping the lead edge of the copy sheet it is possible for image deletions to occur. Other mechanical devices used in the past have involved the use of puffers which try to blow a thin stream of air between the imaging surface and the tacked copy sheet. Like the fingers and grippers, the air stream from the puffers tends to displace the unfixed toner from the copy paper when it is blown between the copy paper and the imaging surface resulting in toner being displaced throughout the machine thereby contaminating sensitive parts. Furthermore, such devices are relatively bulky and expensive in construction.

Another device to have been attempted is the use of a conductive tinsel type device in contact with the paper which relies on the placing of a charge on the back of the paper of a polarity opposite the polarity of charge placed on the paper during transfer. The difficulty with this is that tinsel has a tendency to totally discharge the copy paper where contact occurs resulting in no charge holding the toner in image configuration on the paper. Furthermore, the charge on the photoconductor may be sufficient to keep the majority of the toner material on the photoconductor rather than have it transferred to paper. Thus, in areas where the tinsel has a tendency to totally discharge the paper, the toner will go to the drum resulting in image deletions.

A further device which has been successfully used is the use of a detack corotron which generates a corona discharge of alternating polarity thereby neutralizing the charge on the copy sheet. While this is capable of producing satisfactory detack, AC detack corotrons require a high voltage power supply, are normally very expensive, and the power supplies occupy a relatively large volume. Accordingly, they are particularly unsuitable for use in relatively small, compact, inexpensive copying machines. Furthermore, the wires sometimes break and must be replaced and the alternating current corona may produce excessive amounts of ozone.

PRIOR ART

U.S. Pat. No. 3,575,502 (Eppe) is exemplarly of such an AC corotron device to neutralize charge on a copy sheet.

U.S. Pat. No. 3,757,164 (Binkowski) is directed to a static eliminator which may make complete and intimate contact with the sheet to conduct away static electric charges or may be spaced from a continuous web as an effective induction neutralizer. A brush is placed on both sides of a web or sheet and motion between them is caused to take place to try to take all the charge away by induction.

SUMMARY OF THE INVENTION

In accordance with the present invention, apparatus and method for detacking an electrostatically tacked toner image receiving substrate to an electrostatographic imaging surface are provided. In accordance with the principal aspect of the present invention electrostatographic apparatus comprising means to form an electrostatic latent image of a first polarity on an imaging surface, means to develop the electrostatic latent image with charged toner particles, means to electrostatically transfer the charged toner particles from the imaging surface to a receiving substrate in image configuration by applying a charge of the first polarity to the receiving substrate while the receiving substrate is in contact with the imaging surface and detack means to detack the receiving substrate from the imaging surface comprising a plurality of conductive fibers extending across the receiving substrate tacked to the imaging surface are provided. The fibers are maintained spaced from and out of contact with the receiving substrate and have applied thereto a low voltage direct current potential of a polarity opposite the polarity applied by the electrostatic transfer means to the receivng substrate and sufficient to cause air breakdown between the receiving substrate and the ends of the fibers to provide a substantially uniform neutralization of charge on the receiving substrate and thereby detack the receiving substrate from the imaging surface.

In a specific aspect of the present invention, the imaging surface is a rotatable cylindrical drum and the plurality of fibers are arranged in the configuration of a fibrous brush.

In a further aspect of the present invention, the brush is mounted on an insulating support with a plurality of insulating guards mounted to the support to provide a guide path for the sheet being detacked from the imaging surface to pass the ends of the brush without contacting them.

In a further aspect of the present invention, the potential remaining on the substrate after detacking is sufficiently low to permit the substrate to separate from the drum by virtue of its weight and beam strength, but is above the level at which toner will not be electrostatically attracted to the imaging surface.

Accordingly, it is an object of the present invention to provide apparatus and method for detacking an electrostatically tacked toner receiving sheet from the imaging surface.

It is a further object of the present invention to provide a simple, relatively inexpensive, compact apparatus for detacking a tacked copy sheet to an electrostatographic imaging drum.

It is a further object of the present invention to provide a device for detacking a copy sheet tacked to an electrostatographic imaging drum without requiring a large expensive A.C. high voltage power supply.

It is an additional object of the present invention to provide a device for detacking a copy sheet tacked to an imaging surface without destroying the toner image on the imaging surface.

It is a further object of the present invention to provide a device for detacking a copy sheet tacked to an electrostatographic imaging surface without reducing the charge on the tacked sheet to zero.

It is a further object of the present invention to provide a device for detacking a copy sheet tacked to an electrostatographic imaging surface without physically contacting the tacked sheet.

It is a further object of the present invention to provide a device for discharging an electrostatically tacked sheet in a controlled manner.

For a better understanding of the invention, as well as other objects and further features thereof, reference is had to the following drawings and descriptions.

FIGS. *4a*, *4b* and *4c* illustrates respectively the charge on the photoreceptor and toner, the charge on the paper during transfer and the neutralizing charge generated by the detacking apparatus according to the present invention.

Figure 5:
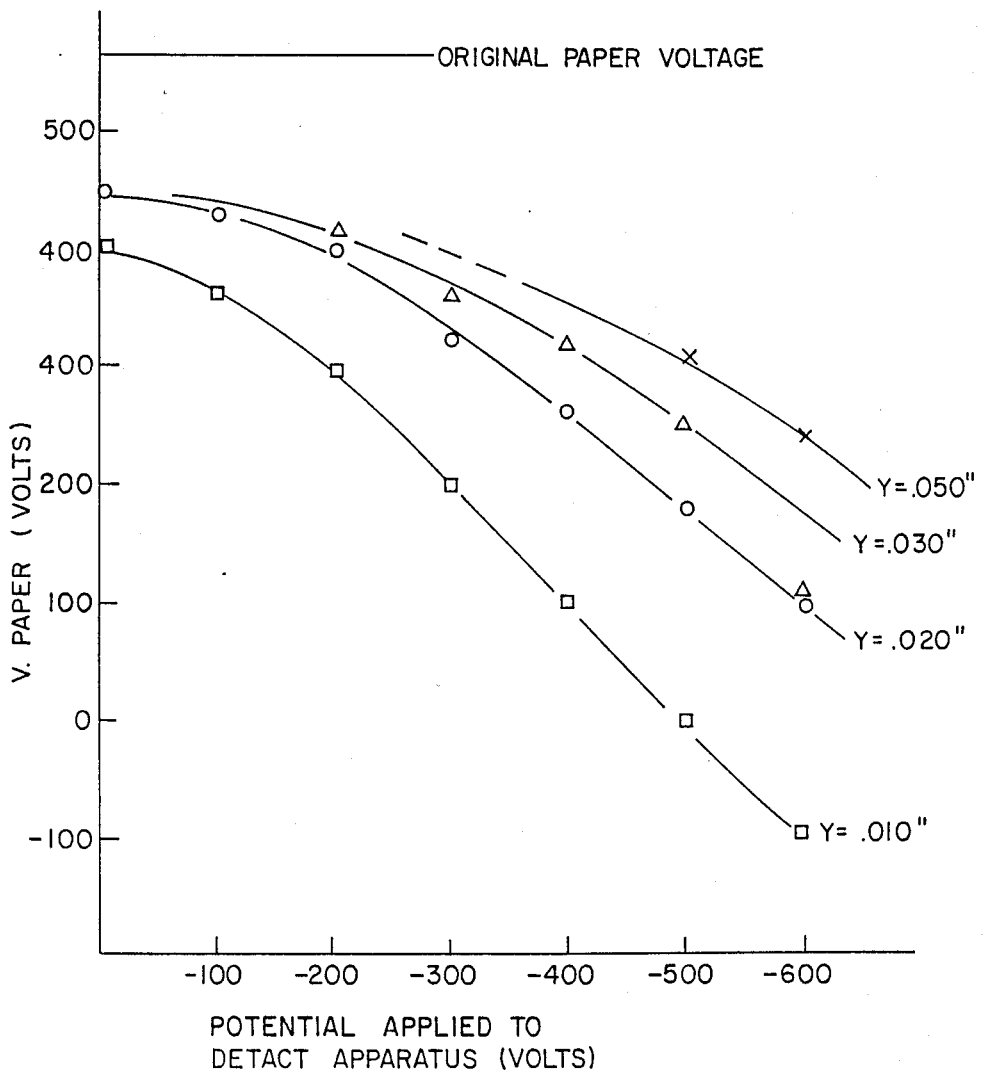

FIG. 5 is a graph illustrating the neutralization of charge on the paper for different potentials applied to the detack apparatus at various gaps between the fiber ends and the paper.

DESCRIPTION OF PREFERRED EMBODIMENT

The invention will now be described by reference to a preferred embodiment.

Figure 1:
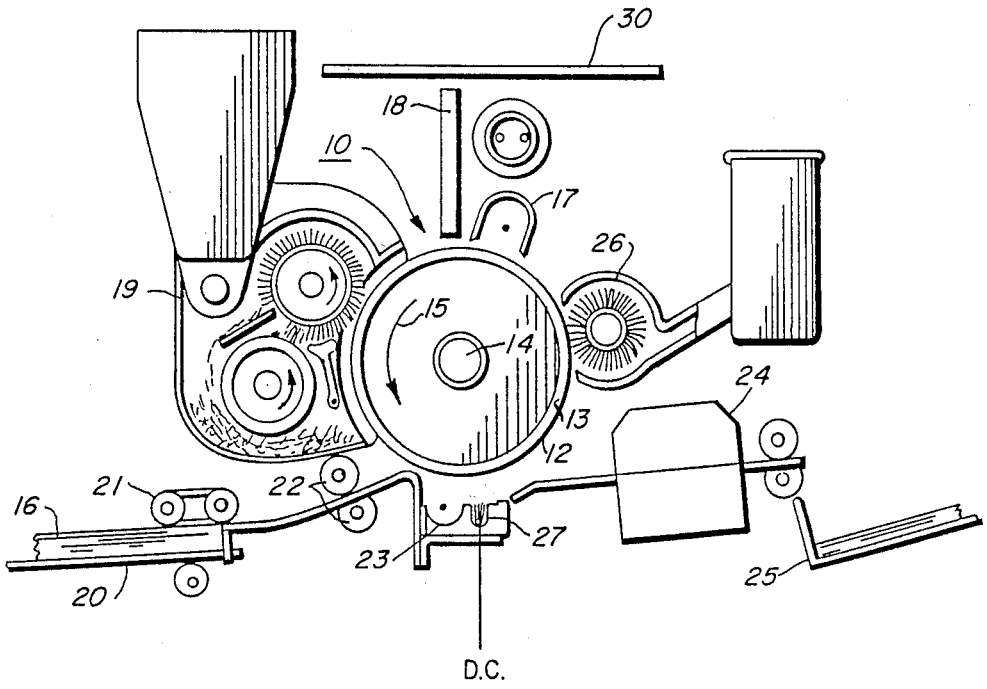
FIG. 1 is a schematic representation in cross section of an automatic electrostatographic reproducing machine with the apparatus for detacking a tacked transfer sheet according to the present invention.

Referring now to FIG. 1 there is shown by way of example an automatic xerographic reproducing machine 10 which includes the detacking apparatus of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 where a conventional developer mix is applied to the photoconductive surface of the drum 12 rendering the latent image visible. Typically a suitable development station could include a magnetic brush development system utilizing a magnetizable developer mix having coarse ferromagnetic carrier granules and colored toner particles.

Sheets 16 of the final support material are supported in a stack arrangement on an elevating stack support tray 20. With the stack at its elevated position a sheet separator feed belt 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. This is achieved by virtue of a transfer corotron 23 which applies a potential to the back of the support material of the same polarity as the charge on the imaging surface. Typically the charge is of a magnitude sufficient to attract the toner to the support material from the imaging surface.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a rotating brush cleaner.

Normally, when the copier is operated in a conventional mode, the original document to be reproduced is placed image side down upon a horizontal transparent viewing platen 30 and the document is transported past an optical arrangement here illustrated as Selfoc lens 18. The speed of moving platen and the speed of the photoconductive drum are synchronized to provide a faithful reproduction of the original document.

It is believed that the foregoing general description is sufficient for purposes of the present application to illustrate the general operation of an automatic xerographic copier 10 which can embody the apparatus in accordance with the present invention.

Figure 2:
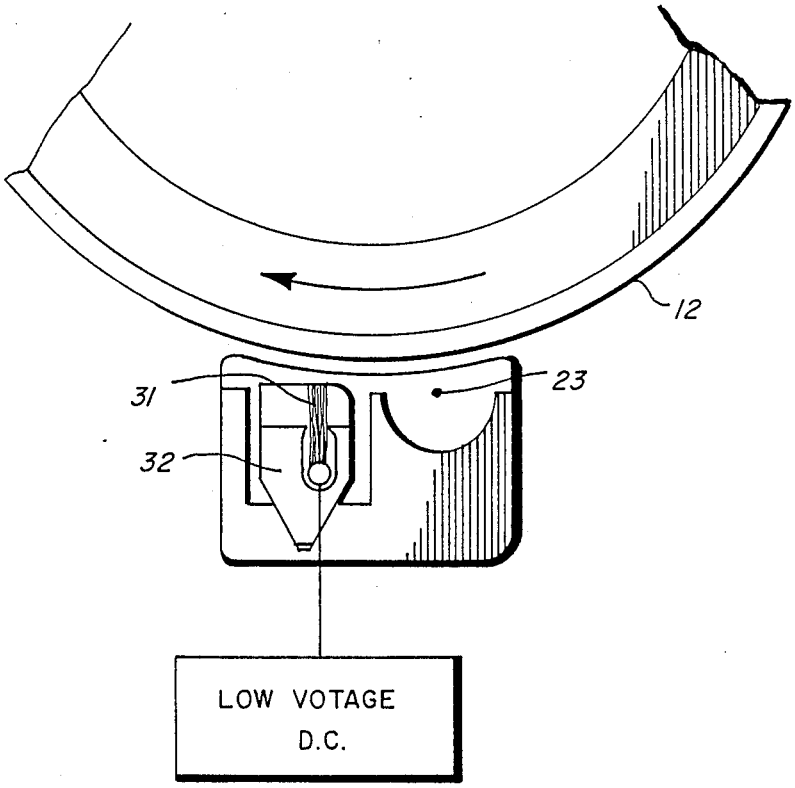
FIG. 2 is an enlarged view in cross section of the detacking apparatus according to the present invention.
Figure 3:
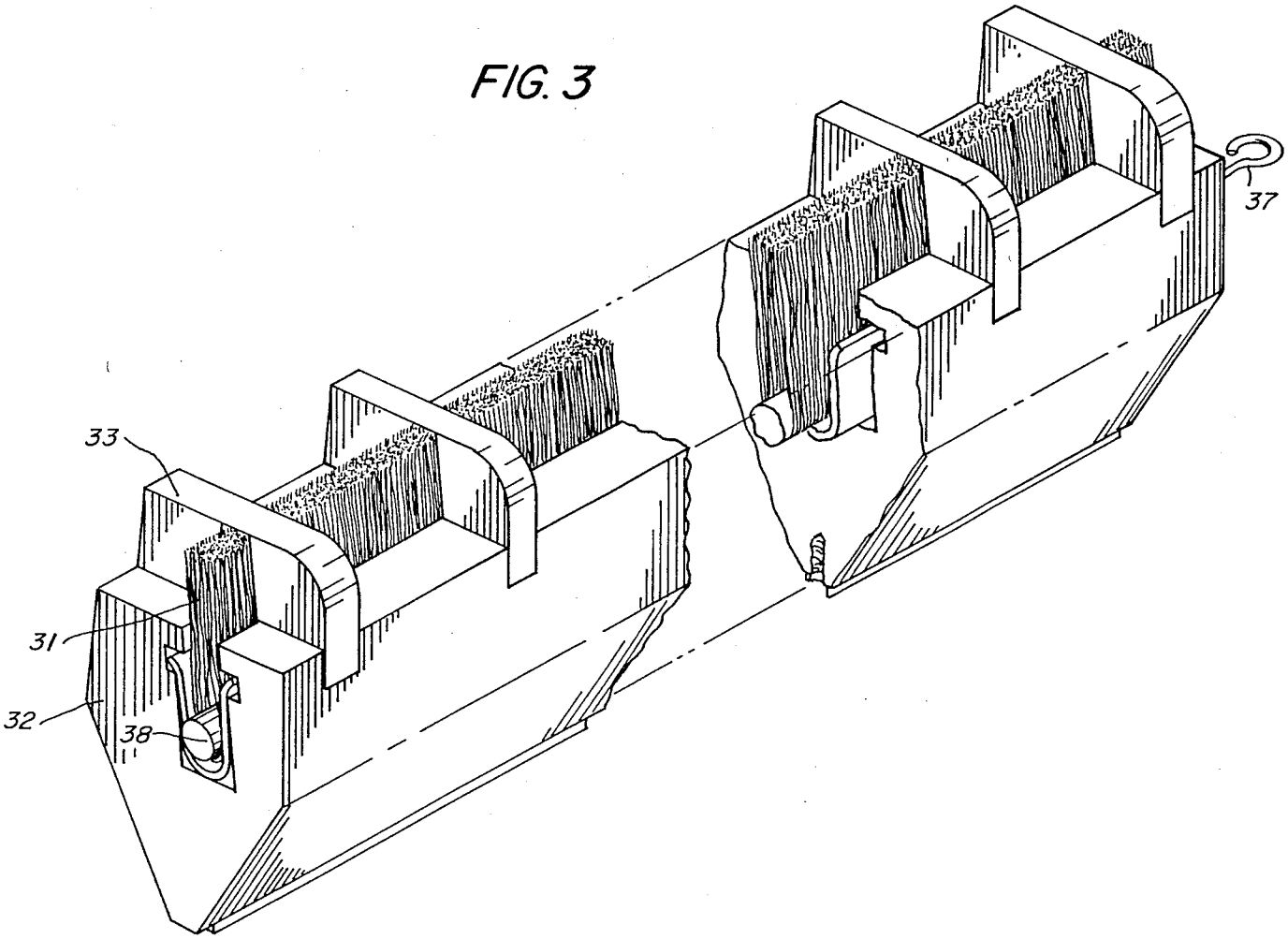
FIG. 3 is an isometric view of the detacking apparatus according to the present invention.

With continued reference to FIGS. 2–4, the detack apparatus according to the present invention is shown in greater detail. The detack apparatus which is positioned in the imaging station path immediately after the transfer corona generating device comprises a plurality of conductive fibers 31 fixedly held in place in insulating support holder 32. The open end of the array of fibers 31 between the sides of the insulating support holder 32 has a plurality of insulating guard members 33 across the aperture to maintain the detacked or stripped receiving substrate out of contact with the fibers. With the guards in place the copy sheet will not be intercepted by the brush which otherwise could lead to a paper jam and machine shutdown. The other end of the array of fibers is connected to a low voltage direct current power supply 36 through lead 37. Typically, the plurality of conductive fibers are arranged in a tightly packed brush like configuration which may take the form illustrated in FIGS. 2 and 3 where the fibers are folded around a conductive rod 38 which is attached to lead 37. Typically the packed fiber number density in such structures may be from about $1\times10^5/cm^2$ to about $2\times10^6/cm^2$.

The individual fibers of the brush may be made of any suitable conductive fiber having a conductivity of from about $10^{-10}(ohm\text{-}cm)^{-1}$ to about $10^4(ohm\text{-}cm)^{-1}$ and a fiber diameter of from about 2 microns to about 20 microns. Typical materials from which the brush may be made are stainless steel and carbon. A preferred material are the brush like arrays of organic filaments of minute diameter which are made by thermochemically converting regenerated cellulose fiber starting material to correspondingly black insulative organic fiber and then carbonizing the latter to provide a corresponding conductive fiber according to the teachings of U.S. Pat. Nos. 3,235,323 and 3,484,183, the disclosures of which are hereby totally incorporated by reference herein.

Any suitable material may be used as the receiving substrate. Typically, it takes the form of paper or a relatively thin paper like material in copy sheet or web form and is sufficiently dielectric in nature to hold a charge.

Figure 4A:
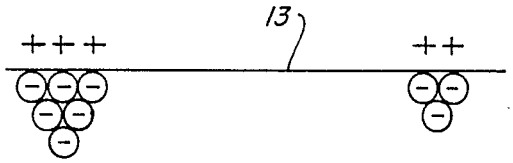
Figure 4B:
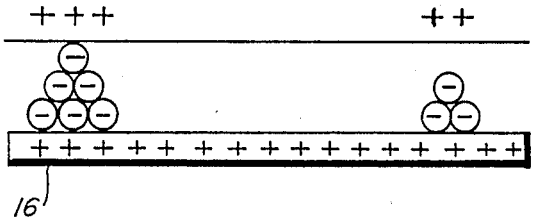

The operation of the detack device of the present invention will be described in greater detail with particular reference to FIGS. 4*a*, 4*b*, and 4*c*, wherein the several charge relationships are shown in greater detail. In the imaging process, the photoconductive insulating layer 13 is first charged to, for example, 800 volts and exposed to a light and shadow pattern to create an electrostatic latent image generally depicted as the charged photoconductor in FIG. 4*a*. The electrostatic latent image is developed with toner particles charged to the opposite polarity and the toner image is then contacted with a toner receiving substrate 16 such as ordinary paper. The back of the paper sheet is then exposed to corona emissions from the transfer corotron to provide a charge of the same polarity and just slightly greater in magnitude, about 20–50 volts greater, than the charge on the imaging surface which overpowers the charge in the imaging surface to enable the toner particles to make the jump from the drum to the paper. As noted in FIGS. 4*a*, 4*b*, and 4*c*, the toner typically is depicted in piles on the imaging surface and during this transfer operation not quite all the toner is transferred to the copy sheet thereby requiring that the imaging surface be subsequently cleaned. During the electrostatic transfer procedure, electrostatic forces are created which cause an attraction between the copy sheet and the imaging surface so that the copy sheet tends to adhere to the imaging surface. As may be seen with reference to FIG. 4*c*, a strong positive charge resides on the paper surface in the background areas before neutralization by the detack device. This charge induces an equal negative counter charge on the conductive substrate (not shown) of the imaging surface. The tacking forces acting between the paper and the imaging surface substrate are analogous to the forces putting two capacitor plates together in a parallel plate capacitor which typically amounts to about 1000 to about 2500 newtons per square meter for 75 micron thick paper, charged to about 1000 volts and a 60 micron thick imaging surface. This electrostatic tacking force has to be counteracted by gravitation and paper beam strength forces. The gravitational forces however are relatively weak with paper weighing 80 grams per square meter, for example, having a force of only about 0.78 newtons per square meter. On the other hand while the beam strength of the paper can provide added detack forces the electrostatic tacking force has to be substantially reduced to avoid paper jamming. Since the electrostatic forces are proportioned to the square of the voltage, by neutralizing the transfer charge on the paper back surface to about 100 volts, the electrostatic forces in the background region are reduced to about 10 to about 25 newtons per square meter which is in the region where the paper beam strength can overcome the tacking forces.

Figure 4C:
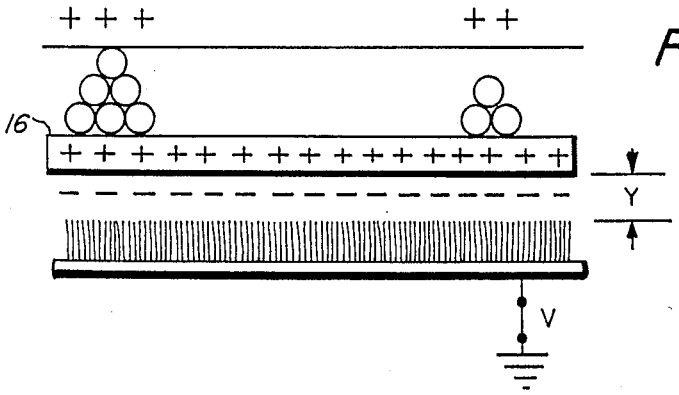

FIG. 4*c* illustrates the neutralization of the attractive forces on the copy sheet by the detack device according to the present invention. A direct current potential sufficient to cause air breakdown in the air between the ends of the brush fibers and the back of the paper is applied to the ends of the brush. The polarity of charge is opposite the charge on the back of the copy sheet so that the air breakdown provides a controlled neutralization of the charge on the back of the copy sheet to a level above zero. This is necessary to insure that the toner remains electrostatically attracted to the receiving substrate, and permits the copy sheet to separate from the drum of FIG. 1 by virture of its own weight and beam strength. To provide this type of detracking operation a direct current potential of from about −600 to about −1000 volts is applied to the ends of the brush fibers which are separated from the imaging surface a distance of from about 0.010 inches to about 0.075 inches, preferably from about 0.030 inches to about 0.050 inches. By maintaining the brush out of contact with the copy sheet drag on the copy sheet is eliminated and complete neutralization of the charge on the copy sheet is avoided thereby insuring that the toner is electrostatically held on the copy sheet to avoid image deletions and retransfer of the toner back to the drum. In addition, the separation of the copy paper from the ends of the fibers enables the use of copy sheets of varying thicknesses and minimizes the possibility of the paper driving into the brush.

The potential applied to the ends of the fibrous brush is sufficient to bring the voltage in the air gap between the copy sheet and the brush ends to a level where air breakdown will occur. By air breakdown we intend to define the ionization of air in the space between the brush ends and the copy sheet which partially discharges the charge on the back of the copy sheet in a controlled manner. Because of the small geometry of pin heads of the brush, very strong small or microelectric fields enhance the air breakdown process at relatively low D.C. potentials. Thus a potential of the order of −500 or −600 volts on the ends of brush fibers will cause air breakdown while a plane electrode would require upwards of 1500 volts to cause air breakdown at comparable air gap spacings. Thus while induction may play a part in neutralizing the charge on the copy sheet, the potential on the brushes cause an electric field enhancement to the point of ionization and thereby directly discharges the charge on the back of the copy sheet placed there by the transfer corotron. Thus a uniform neutralizating of the charge is obtained and the potential remaining on the back of the copy sheet is substantially the same through out the copy sheet providing consistent and uniform detacking of the copy sheet from the imaging surface.

The low voltage direct current power supplies that can be used in the detack apparatus of the present invention are comparatively simple, small and inexpensive when compared to the high voltage A.C. corona generating devices of the prior art. Typically they can be of a size of about one cubic inch and therefore readily lend themselves to use in small or compact reproducing machines. Furthermore, the out of contact fiber brush device does not have the tendency to totally discharge the copy sheet resulting in image deletions since the toner in the discharged areas will then once again be attracted to the charged imaging surface. Instead, it provides a controlled neutralization of charge to a desired level. In this regard, attention is directed to FIG. 5 which graphically illustrates the copy sheet voltage after the copy sheet has been subjected to neutralization with a stated negative potential applied to the ends of the brush fibers. The four graphs represent the results achieved at different spacings, y, of the brush ends from the back of the copy sheet.

While the above invention has been described with reference to specific embodiments, it will be apparent to those skilled in the art that many alternatives, modifications and variations may be made. It is intended to embrace all such alternatives, modifications and variations as may fall within the spirit and scope of the appended claims.

We claim:

1. Electrostatographic apparatus comprising means to form an electrostatic latent image of a first polarity on an imaging surface, means to develop said electrostatic latent image with charged toner particles, means to contact said developed image with a toner image receiving substrate, means to electrostatically transfer charged toner particles from the imaging surface to the receiving substrate in image configuration by applying a charge of said first polarity to said receiving surface while said receiving surface is in contact with said imaging surface, and means to detack said receiving substrate from said imaging surface, said detack means comprising a plurality of conductive fibers extending across the rear side of the receiving substrate tacked to the imaging surface, said fibers being maintained spaced from and out of contact with the receiving surface and having applied thereto a low voltage direct current potential of a polarity opposite the polarity applied by said electrostatic transfer means to said receiving surface and sufficient to cause air breakdown between the receiving substrate and the ends of the fibers to provide a controlled neutralization of charge on the receiving substrate to a potential level above zero and thereby permit said receiving substrate to separate from said imaging surface by virtue of its own weight and beam strength.

2. The apparatus according to claim 1 wherein said plurality of fibers are arranged in the configuration of a fibrous brush.

3. The apparatus according to claim 2 wherein said fibers have a conductivity of from about $1\times10^{-10}$(ohm-cm)$^{-1}$ to about $1\times10^{4}$(ohm-cm)$^{-1}$.

4. The apparatus according to claim 2 wherein said fibers are carbon or stainless steel.

5. The apparatus according to claim 2 wherein said brush is mounted on an insulating support and a plurality of insulating guards are mounted to said support to provide a guide path for the sheet being detacked from the imaging surface to pass the ends of the brush without contacting them.

6. The apparatus according to claim 1 wherein said imaging surface is the surface of a rotatable cylindrical imaging drum.

7. The apparatus according to claim 1 wherein the potential on the receiving substrate is reduced to a level above the level at which toner will not be electrostatically attracted to the imaging surface.

8. The apparatus of claim 1 wherein the detack ends of the plurality of fibers is spaced from about 0.030 inches to about 0.050 inches from the imaging surface.

9. The apparatus of claim 1 wherein said means to electrostatically transfer toner comprises a corona discharge device to place a charge on the receiving substrate.

10. A method of detacking a toner image receiving substrate tacked to an electrostatographic imaging surface comprising the steps of providing a plurality of conductive fibers extending across the rear side of the receiving substrate tacked to the imaging surface, maintaining said fibers spaced from and out of contact with the receiving surface and applying thereto a low voltage direct current potential of a polarity opposite the polarity applied by said electrostatic transfer means to said receiving surface and sufficient to cause air breakdown between the receiving substrate and the ends of the fibers to provide a controlled neutralization of charge on the receiving substrate and thereby permit said receiving substrate to a potential level above zero from said imaging surface by virtue of its own weight and beam strength.

11. The method according to claim 10 wherein said plurality of fibers are arranged in the configuration of a fibrous brush.

12. The method according to claim 11 wherein said fibers have a conductivity of from about $1\times10^{-10}$(ohm-cm)$^{-1}$ to about $1\times10^{4}$(ohm-cm)$^{-1}$.

13. The method according to claim 11 wherein said fibers are carbon or stainless steel.

14. The method according to claim 10 wherein the potential on the receiving substrate is reduced to a level above the level at which toner will not be electrostatically attracted to the imaging surface.

15. The method of claim 10 wherein the detack ends of the plurality of fibers are spaced from about 0.030 inches to about 0.050 inches from the imaging surface.

* * * * *